US011286638B2

(12) United States Patent
Saigo et al.

(10) Patent No.: US 11,286,638 B2
(45) Date of Patent: Mar. 29, 2022

(54) LOADING MACHINE CONTROL DEVICE AND CONTROL METHOD

(71) Applicant: Komatsu Ltd., Tokyo (JP)

(72) Inventors: Yusuke Saigo, Tokyo (JP); Kazuhiro Hatake, Tokyo (JP)

(73) Assignee: Komatsu Ltd., Tokyo (JP)

( * ) Notice: Subject to any disclaimer, the term of this patent is extended or adjusted under 35 U.S.C. 154(b) by 197 days.

(21) Appl. No.: 16/647,723

(22) PCT Filed: Aug. 13, 2018

(86) PCT No.: PCT/JP2018/030173
§ 371 (c)(1),
(2) Date: Mar. 16, 2020

(87) PCT Pub. No.: WO2019/150616
PCT Pub. Date: Aug. 8, 2019

(65) Prior Publication Data

US 2020/0224385 A1 Jul. 16, 2020

(30) Foreign Application Priority Data

Jan. 31, 2018 (JP) ..... JP2018-015820

(51) Int. Cl.
*E02F 3/43* (2006.01)
*E02F 3/30* (2006.01)
(Continued)

(52) U.S. Cl.
CPC ..... *E02F 3/435* (2013.01); *E02F 3/32* (2013.01); *E02F 9/2203* (2013.01);
(Continued)

(58) Field of Classification Search
CPC ... E02F 3/32; E02F 3/435; E02F 3/439; E02F 9/2033; E02F 9/2203; E02F 9/2296; E02F 9/262; E02F 9/265
See application file for complete search history.

(56) References Cited

U.S. PATENT DOCUMENTS 6,449,884 B1 * 9/2002 Watanabe ..... E02F 9/2296 37/348
8,200,398 B2 * 6/2012 Sahlin ..... E02F 3/847 701/50

(Continued)

FOREIGN PATENT DOCUMENTS

| | | |
|---|---|---|
| JP | 2002115271 | 4/2002 |
| JP | 2002167794 | 6/2002 |
| WO | 2017126182 | 7/2017 |

*Primary Examiner* — Tyler J Lee
(74) *Attorney, Agent, or Firm* — Fish & Richardson P.C.

(57) ABSTRACT

An avoidance position specification unit specifies an interference avoidance position that is higher than a loading object and has no loading object therebelow. A timing determination unit determines a swing start timing based on a remaining swing angle formed by a straight line that extends from a center of swing to a work equipment and a straight line that extends from the center of swing to an interference avoidance position, and a height of the interference avoidance position. An operation signal output unit outputs an operation signal of the work equipment in a case of not reaching the swing start timing and outputs an operation signal for swinging a swing body at swing speed higher than that when not reaching the swing start timing and an operation signal of the work equipment, in a case of reaching the swing start timing.

5 Claims, 13 Drawing Sheets

(51) Int. Cl.

| | |
|---|---|
| ***E02F 3/32*** | (2006.01) |
| *E02F 9/22* | (2006.01) |
| *E02F 9/26* | (2006.01) |

(52) U.S. Cl.
CPC ..... *E02F 9/2296* (2013.01); *E02F 9/262* (2013.01); *E02F 9/265* (2013.01)

(56) References Cited

U.S. PATENT DOCUMENTS

| | | | | |
|---|---|---|---|---|
| 9,637,887 | B2 * | 5/2017 | Wighton | E02F 3/18 |
| 2007/0260380 | A1 * | 11/2007 | Mintah | E02F 9/264 701/50 |
| 2015/0247301 | A1 * | 9/2015 | Wighton | E02F 3/18 701/50 |
| 2016/0002881 | A1 * | 1/2016 | Park | E02F 9/2029 701/50 |
| 2018/0016767 | A1 | 1/2018 | Ge et al. | |
| 2018/0119384 | A1 | 5/2018 | Imaizumi et al. | |

* cited by examiner

LOADING MACHINE CONTROL DEVICE AND CONTROL METHOD

CROSS-REFERENCE TO RELATED APPLICATIONS

This application is a National Stage application under 35 U.S.C. § 371 of International Application No. PCT/JP2018/030173, filed on Aug. 13, 2018, which claims priority to Japanese Patent Application No. 2018-015820, filed on Jan. 31, 2018. The contents of the prior applications are incorporated herein in their entirety.

TECHNICAL FIELD

The present invention relates to a loading machine control device and a control method.

BACKGROUND ART

PTL 1 discloses a technique related to automatic loading control of a loading machine. In the loading machine described in PTL 1, an excavation start position, a dumping position, and a standby position are taught in advance, and a swing body and a work equipment are operated such that the position of the loading machine matches the taught position data.

CITATION LIST

Patent Literature

[PTL 1] Japanese Unexamined Patent Application, First Publication No. 2002-115271

DISCLOSURE OF INVENTION

Technical Problem

Incidentally, in a case where loading earth on a loading object (for example, a vessel or a hopper of a transport vehicle), it is necessary to perform loading processing above the loading object. Therefore, in a case of making the loading machine perform automatic loading, it is necessary to automatically move a bucket above the loading object in a process of the automatic loading. At this time, the loading machine needs to operate the work equipment and the swing body such that the work equipment does not come into contact with an outer shell of the loading object in the automatic loading control.

An objective of the present invention is to provide a loading machine control device and a control method for controlling an automatic loading in view of an outer shell of a loading object.

Solution to Problem

A first aspect of the present invention provides a control device for controlling a loading machine including a swing body that swings around a center of swing and a work equipment that is attached to the swing body and has a bucket, the control device including: an avoidance position specification unit that is configured to specify an interference avoidance position which is a bucket position that is higher than a loading object and has no loading object therebelow; a timing determination unit that is configured to determine a swing start timing based on a remaining swing angle and a height of the interference avoidance position, the remaining swing angle being formed by a straight line that extends from the center of swing to the work equipment and a straight line that extends from the center of swing to the interference avoidance position in a plan view from above; and an operation signal output unit that is configured to output an operation signal of the work equipment in a case of not reaching the swing start timing and output an operation signal for swinging the swing body at swing speed higher than that when not reaching the swing start timing and an operation signal of the work equipment, in a case of reaching the swing start timing.

Advantageous Effects of Invention

According to at least one aspect among the above-described aspects, the control device can control automatic loading in view of the outer shell of the loading object.

BEST MODE FOR CARRYING OUT THE INVENTION

Hereinafter, embodiments will be described with reference to the drawings.

First Embodiment

<<Configuration of Loading Machine>>

Figure 1:
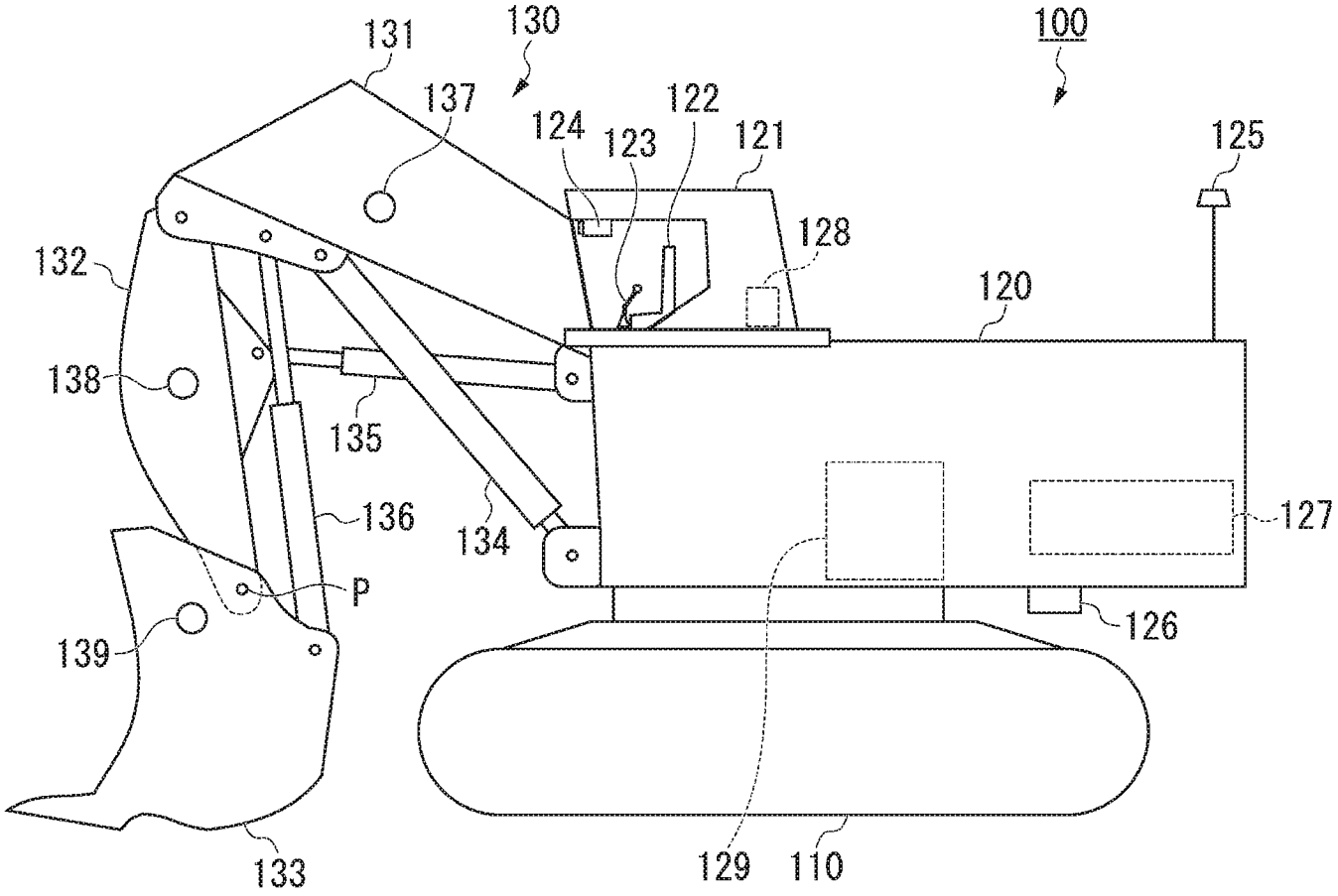
FIG. 1 is a schematic view showing a configuration of a loading machine according to a first embodiment.

FIG. 1 is a schematic view showing a configuration of a loading machine according to a first embodiment.

A loading machine 100 is a work machine for loading earth onto a loading object 200, such as a transport vehicle. The loading machine 100 according to the first embodiment is a hydraulic shovel. The loading machine 100 according to another embodiment may be a loading machine other than a hydraulic shovel. In addition, the loading machine 100 shown in FIG. 1 is a face shovel, but may be a backhoe shovel or a rope shovel. Examples of the loading object 200 include a transport vehicle and a hopper.

The loading machine 100 includes a traveling body 110, a swing body 120 supported by the traveling body 110, and a work equipment 130 operated by hydraulic pressure and supported by the swing body 120. The swing body 120 is supported by the traveling body 110 so as to be capable of swinging around a center of swing.

The work equipment 130 includes a boom 131, an arm 132, a bucket 133, a boom cylinder 134, an arm cylinder 135, a bucket cylinder 136, a boom angle sensor 137, an arm angle sensor 138, and a bucket angle sensor 139.

A base end portion of the boom 131 is attached to the swing body 120 via a pin.

The arm 132 connects the boom 131 and the bucket 133 to each other. A base end portion of the arm 132 is attached to a tip end portion of the boom 131 via a pin.

The bucket 133 includes a blade for excavating earth and a container for accommodating the excavated earth. A base end portion of the bucket 133 is attached to the tip end portion of the arm 132 via a pin.

The boom cylinder 134 is a hydraulic cylinder for operating the boom 131. A base end portion of the boom cylinder 134 is attached to the swing body 120. A tip end portion of the boom cylinder 134 is attached to the boom 131.

The arm cylinder 135 is a hydraulic cylinder for driving the arm 132. A base end portion of the arm cylinder 135 is attached to the boom 131. A tip end portion of the arm cylinder 135 is attached to the arm 132.

The bucket cylinder 136 is a hydraulic cylinder for driving the bucket 133. A base end portion of the bucket cylinder 136 is attached to the boom 131. A tip end portion of the bucket cylinder 136 is attached to the bucket 133.

The boom angle sensor 137 is attached to the boom 131 and detects an inclination angle of the boom 131.

The arm angle sensor 138 is attached to the arm 132 and detects an inclination angle of the arm 132.

The bucket angle sensor 139 is attached to the bucket 133 and detects an inclination angle of the bucket 133.

The boom angle sensor 137, the arm angle sensor 138, and the bucket angle sensor 139 according to the first embodiment detect the inclination angle with respect to a ground plane. In addition, the angle sensor according to another embodiment is not limited thereto, and may detect the inclination angle with respect to another reference plane. For example, in another embodiment, the angle sensor may detect a relative rotation angle with a potentiometer provided at the base end portions of the boom 131, the arm 132, and the bucket 133, or may detect the inclination angle by measuring the cylinder lengths of the boom cylinder 134, the arm cylinder 135, and the bucket cylinder 136, and by converting the cylinder length into an angle.

The swing body 120 is provided with a cab 121. Inside the cab 121, a driver seat 122 for an operator to sit on, an operation device 123 for operating the loading machine 100, and a detection device 124 for detecting a three-dimensional position of an object that exists in a detecting direction, are provided. In response to an operation of the operator, the operation device 123 generates an operation signal of the boom cylinder 134, an operation signal of the arm cylinder 135, an operation signal of the bucket cylinder 136, a swing operation signal to the left and right of the swing body 120, and a traveling operation signal for forward and backward traveling of the traveling body 110, and outputs the operation signals to a control device 128. In addition, the operation device 123 generates a loading command signal for causing the work equipment 130 to start automatic loading control in accordance with the operation of the operator, and outputs the loading command signal to the control device 128. The loading command signal is an example of a command to start automatic movement of the bucket 133. The operation device 123 is configured with, for example, a lever, a switch, and a pedal. The loading command signal is operated by operating a switch. For example, when the switch is pressed, a loading command signal is output. The operation device 123 is disposed in the vicinity of the driver seat 122. The operation device 123 is positioned within a range that can be operated by the operator when the operator sits on the driver seat 122.

Examples of the detection device 124 include a stereo camera, a laser scanner, and an ultra-wide band (UWB) distance measuring device. The detection device 124 is provided such that the detecting direction faces the front of the cab 121 of the loading machine 100, for example. The detection device 124 specifies the three-dimensional position of the object in a coordinate system with the position of the detection device 124 as a reference.

In addition, the loading machine 100 according to the first embodiment is operated according to the operation of the operator who sits on the driver seat 122, but is not limited thereto in another embodiment. For example, the loading machine 100 according to another embodiment may be operated by transmitting an operation signal or a loading command signal by a remote operation of an operator who operates outside the loading machine 100.

The loading machine 100 includes a position and azimuth direction calculator 125, an inclination measuring device 126, a hydraulic device 127, the control device 128, and a swing motor 129.

The position and azimuth direction calculator 125 calculates the position of the swing body 120 and the azimuth direction in which the swing body 120 faces. The position and azimuth direction calculator 125 includes two receivers that receive positioning signals from artificial satellites that configure a GNSS. The two receivers are respectively installed at different positions on the swing body 120. Based on the positioning signal received by the receiver, the position and azimuth direction calculator 125 detects the position of the representative point (the origin of the shovel coordinate system) of the swing body 120 in a field coordinate system.

The position and azimuth direction calculator 125 calculates the azimuth direction in which the swing body 120 faces as a relationship between the installation position of one receiver and the installation position of the other receiver by using each positioning signal received by the two receivers.

The inclination measuring device 126 measures an acceleration and an angular velocity (swing speed) of the swing body 120 and detects the attitude (for example, roll angle, pitch angle, yaw angle) of the swing body 120 based on the measurement result. The inclination measuring device 126 is installed on a lower surface of the swing body 120, for example. For example, an inertial measurement unit (IMU) can be used as the inclination measuring device 126.

The hydraulic device 127 includes a hydraulic oil tank, a hydraulic pump, and a flow control valve. The hydraulic pump is driven by the power of an engine (not shown) and supplies hydraulic oil to the swing motor 129, the boom cylinder 134, the arm cylinder 135, and the bucket cylinder 136 via a flow control valve. The flow control valve has a rod-shaped spool, and adjusts the flow rate of the hydraulic oil supplied to the swing motor 129, the boom cylinder 134, the arm cylinder 135, and the bucket cylinder 136 according to the position of the spool. The spool is driven based on a control command received from the control device 128. In other words, the amount of hydraulic oil supplied to the swing motor 129, the boom cylinder 134, the arm cylinder 135, and the bucket cylinder 136 is controlled by the control device 128. As described above, the swing body 120 and the work equipment 130 are driven by the hydraulic oil supplied from the common hydraulic device 127. Therefore, the flow rate of the hydraulic oil supplied to the boom cylinder 134, the arm cylinder 135, and the bucket cylinder 136 when the swing body 120 and the work equipment 130 are operating is smaller than the flow rate of the hydraulic oil supplied to the boom cylinder 134, the arm cylinder 135, and the bucket cylinder 136 when only the work equipment 130 is operating.

The control device 128 receives the operation signal from the operation device 123. The control device 128 drives the work equipment 130, the swing body 120, or the traveling body 110 based on the received operation signal.

The swing motor 129 is a hydraulic motor for swinging the swing body 120. The swing motor 129 is operated by the hydraulic oil supplied from the hydraulic device 127.

<<Configuration of Control Device>>

Figure 2:
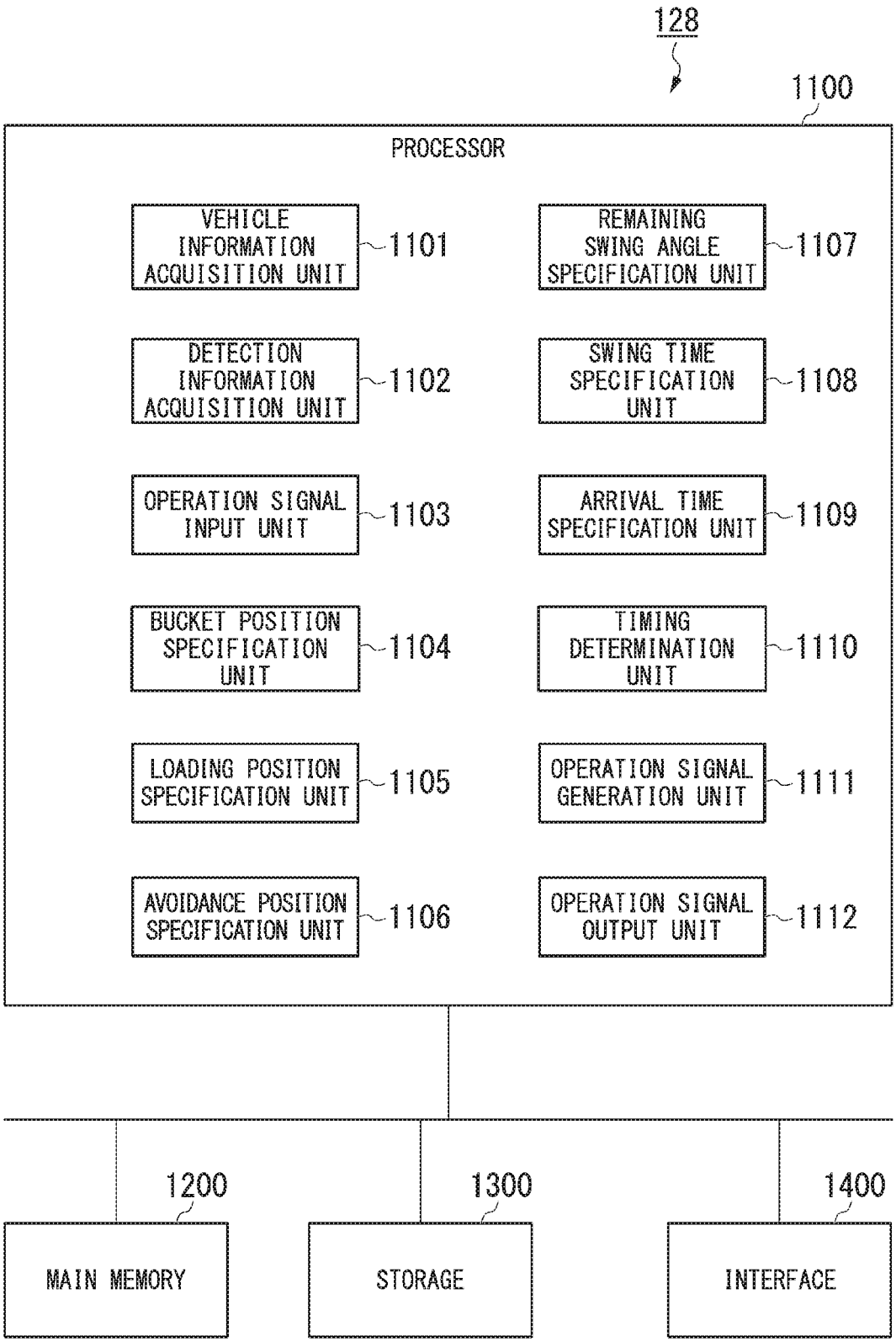
FIG. 2 is a schematic block diagram showing a configuration of a control device according to the first embodiment.

FIG. 2 is a schematic block diagram showing a configuration of the control device according to the first embodiment.

The control device 128 is a computer including a processor 1100, a main memory 1200, a storage 1300, and an interface 1400. The storage 1300 stores a program. The processor 1100 reads the program from the storage 1300, loads the program in the main memory 1200, and executes processing according to the program.

Examples of the storage 1300 include HDDs, SSDs, magnetic disks, magneto-optical disks, CD-ROMs, DVD-ROMs, and the like. The storage 1300 may be an internal medium directly connected to a common communication line of the control device 128, or may be an external medium connected to the control device 128 via the interface 1400. The storage 1300 is a tangible storage medium that is not temporary.

The processor 1100 is executed by a program and includes a vehicle information acquisition unit 1101, a detection information acquisition unit 1102, an operation signal input unit 1103, a bucket position specification unit 1104, a loading position specification unit 1105, an avoidance position specification unit 1106, a remaining swing angle specification unit 1107, a swing time specification unit 1108, an arrival time specification unit 1109, a timing determination unit 1110, an operation signal generation unit 1111, and an operation signal output unit 1112.

The vehicle information acquisition unit 1101 acquires the swing speed, the position, and the azimuth direction of the swing body 120, the inclination angles of the boom 131, the arm 132, and the bucket 133, the traveling speed of the traveling body 110, and the attitude of the swing body 120. Hereinafter, information on the loading machine 100 acquired by the vehicle information acquisition unit 1101 will be referred to as vehicle information.

The detection information acquisition unit 1102 acquires three-dimensional position information from the detection device 124 and specifies the position and the shape of the loading object 200.

The operation signal input unit 1103 receives an operation signal input from the operation device 123. An operation signal of the boom 131, an operation signal of the arm 132, an operation signal of the bucket 133, a swing operation signal of the swing body 120, a traveling operation signal of the traveling body 110, and a loading command signal of the loading machine 100 are included.

Figure 3:
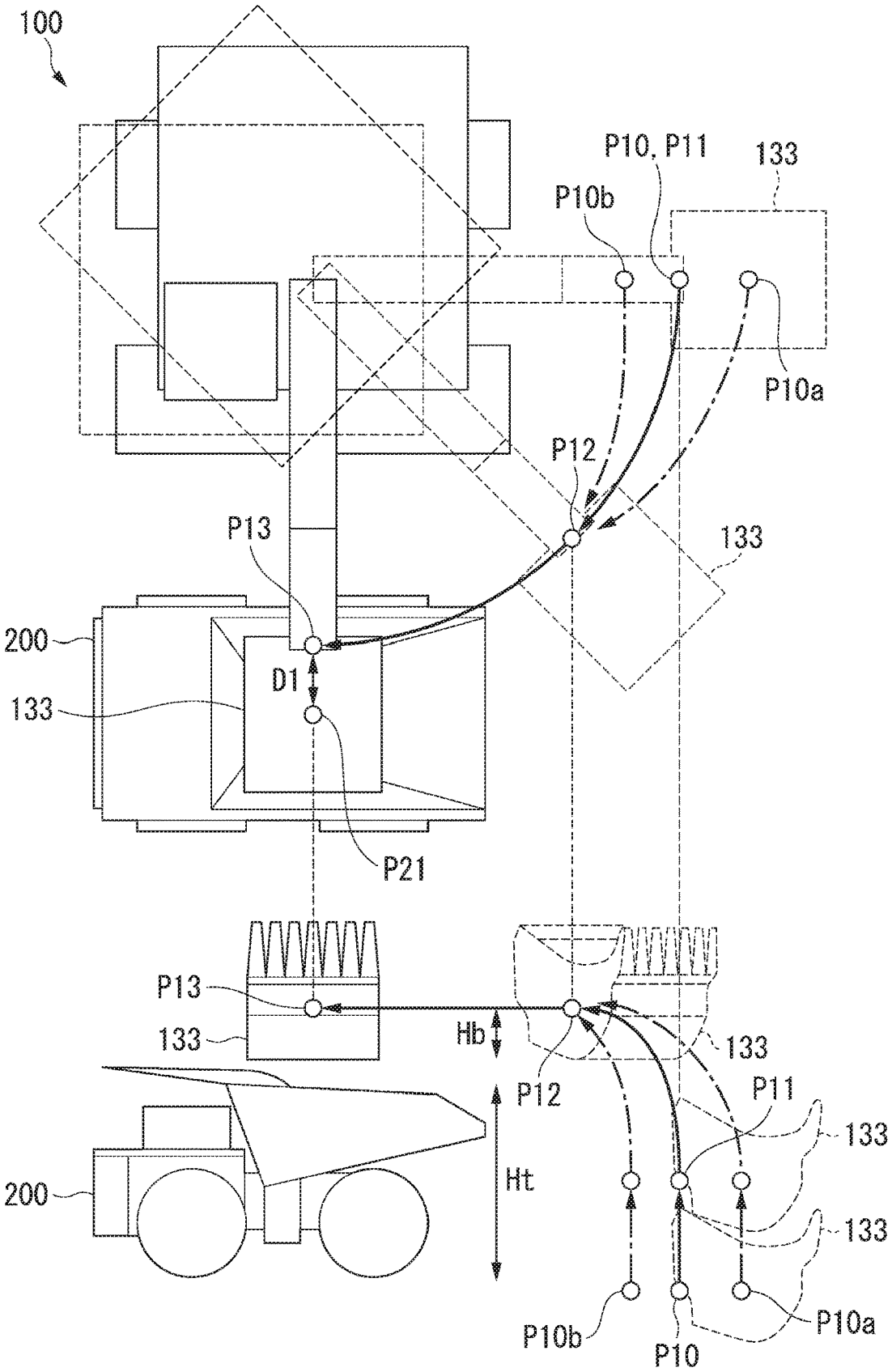
FIG. 3 is a view showing an example of a bucket path according to the first embodiment.

Based on the vehicle information acquired by the vehicle information acquisition unit 1101, the bucket position specification unit 1104 specifies a position P of the tip of the arm 132 in the shovel coordinate system and a height Hb from the tip of the arm 132 to the lowest point of the bucket 133. The lowest point of the bucket 133 means a point having the shortest distance from a ground surface in the outer shape of the bucket 133. In particular, the bucket position specification unit 1104 specifies the position P of the tip of the arm 132 when the input of the loading command signal is received as an excavation completion position P10. FIG. 3 is a view showing an example of a bucket path according to the first embodiment. Specifically, the bucket position specification unit 1104 obtains vertical direction components and horizontal direction components of the length of the boom 131 based on the inclination angle of the boom 131 and the known length (the distance from the pin of the base end portion to the pin at the tip end portion) of the boom 131. Similarly, the bucket position specification unit 1104 obtains the vertical direction components and the horizontal direction components of the length of the arm 132. The bucket position specification unit 1104 specifies a position separated from the position of the loading machine 100 by the sum of the vertical direction components and the sum of horizontal direction components of the lengths of the boom 131 and the arm 132, in the direction specified from the azimuth direction and attitude of the loading machine 100, as the position P (position P of the pin of the tip end portion of the arm 132 shown in FIG. 1) of the tip of the arm 132. Further, the bucket position specification unit 1104 specifies the lowest point in the vertical direction of the bucket 133 based on the inclination angle of the bucket 133 and the known shape of the bucket 133, and specifies the height Hb from the tip of the arm 132 to the lowest point.

The loading position specification unit 1105 specifies a loading position P13 based on the position and the shape of the loading object 200 specified by the detection information acquisition unit 1102 in a case where the loading command signal is input to the operation signal input unit 1103. The loading position specification unit 1105 converts a loading point P21 indicated by the position information of the loading object 200 from the field coordinate system to the shovel coordinate system based on the position, the azimuth direction, and the attitude of the swing body 120 acquired by the vehicle information acquisition unit 1101. The loading position specification unit 1105 specifies a position separated from the specified loading point P21 by a distance D1 from the center of the bucket 133 to the tip of the arm 132 in the direction in which the swing body 120 of the loading machine 100 faces, as a plane position of the loading position P13. In other words, when the tip of the arm 132 is positioned at the loading position P13, the center of the bucket 133 is positioned at the loading point P21. Therefore, the control device 128 is possible to move the center of the bucket 133 to the loading point P21 by controlling the tip of the arm 132 to move to the loading position P13. The loading position specification unit 1105 specifies a height of the loading position P13 by adding the height Hb from the tip of the arm 132 specified by the bucket position specification unit 1104 to the lowest point of the bucket 133 and the height for the control margin of the bucket 133 to a height Ht of the loading object 200. In another embodiment, the loading position specification unit 1105 may specify the loading position P13 without adding the height for the control margin. In other words, the loading position specification unit 1105 may specify the height of the loading position P13 by adding the height Hb to the height Ht.

The avoidance position specification unit 1106 specifies an interference avoidance position P12 that is a point at which the work equipment 130 does not interfere with the loading object 200 based on the loading position P13 specified by the loading position specification unit 1105, the position of the loading machine 100 acquired by the vehicle information acquisition unit 1101, and the position and the shape of the loading object 200 specified by the detection information acquisition unit 1102. The interference avoidance position P12 has the same height as the loading position P13, the distance from the center of swing of the swing body 120 is equal to the distance from the center of swing to the loading position P13, and the interference avoidance position P12 is a position where the loading object 200 is not present downward. In other words, the interference avoidance position P12 is a position which is higher than the loading object 200 and has no loading object 200 therebelow.

The avoidance position specification unit 1106 specifies, for example, a circle which is centered on the center of swing of the swing body 120 and the radius of which is the distance between the center of swing and the loading position P13, and specifies a position at which the outer shape of the bucket 133 does not interfere with the loading object 200 in a plan view among the positions on the circle and which is the closest to the loading position P13 as the interference avoidance position P12. The avoidance position specification unit 1106 can determine whether or not the loading object 200 and the bucket 133 interfere with each other based on the position and the shape of the loading object 200 and the known shape of the bucket 133. Here, "the same height" and "the distances are equal" are not necessarily limited to those in which the heights or distances completely match each other and some errors and margins are allowed.

The remaining swing angle specification unit 1107 specifies a remaining swing angle formed by a straight line that extends from the center of swing to the tip of the arm 132 and a straight line that extends from the center of swing to the interference avoidance position P12 in a plan view from above. In addition, an angle formed by the straight line that extends from the center of swing to the tip of the arm 132 and the straight line that extends from the center of swing to the interference avoidance position P12 in a plan view from above is equal to an angle formed by a horizontal component of the straight line that extends from the center of swing to the tip of the arm 132 and a horizontal component of the straight line that extends from the center of swing to the interference avoidance position P12, and an angle formed by a vertical surface including the tip of the center of swing and the arm 132 and a vertical surface including the center of swing and the interference avoidance position P12.

The swing time specification unit 1108 specifies the required swing time required to swing the swing body by the remaining swing angle specified by the remaining swing angle specification unit 1107. The swing time specification unit 1108 models the swing of the swing body 120 in advance, and specifies the required swing time based on the remaining swing angle, the acceleration of the swing body 120 when the operation signal for operating the swing body 120 with the maximum operation amount is output, and the highest angular velocity of the swing body 120.

The arrival time specification unit 1109 specifies the arrival time until the height of the tip of the arm 132 reaches the height of the interference avoidance position P12 in a case where the swing body 120 and the work equipment 130 are operating. For example, the arrival time specification unit 1109 specifies the arrival time by the following method.

The arrival time specification unit 1109 specifies the lengths of the boom cylinder 134, the arm cylinder 135, and the bucket cylinder 136 when the tip of the arm 132 reaches the height of the interference avoidance position P12. The arrival time specification unit 1109 specifies a volume of the hydraulic oil required until the tip of the arm 132 reaches the height of the interference avoidance position P12 from a difference between a current lengths of the boom cylinder 134, the arm cylinder 135, and the bucket cylinder 136 and the length of the boom cylinder 134, the arm cylinder 135, and the bucket cylinder 136 when the tip of the arm 132 reaches the height of the interference avoidance position P12. In addition, the arrival time specification unit 1109 specifies the arrival time until the height of the tip of the arm 132 reaches the height of the interference avoidance position P12 by dividing the specified volume of the hydraulic oil by the flow rate of the hydraulic oil supplied to the work equipment 130.

In addition, the flow rate of the hydraulic oil supplied to the work equipment 130 used for the calculation is not the flow rate supplied to the work equipment 130 when only the work equipment 130 is operating, but the flow rate supplied to the work equipment 130 when the swing body 120 and the work equipment 130 are operating. In other words, the hydraulic pump supplies the hydraulic oil both to the swing body 120 and the work equipment 130 when the swing body 120 and the work equipment 130 are operating, and at this time, by using the flow rate of the hydraulic oil that flows from the hydraulic oil to the work equipment 130 side, the arrival time specification unit 1109 specifies the arrival time. The flow rate may be, for example, a value obtained from an actual measurement value during an average operation, may be a value calculated based on an engine horsepower and a pump pressure of the loading machine 100, may be a value calculated based on the engine speed of the loading machine 100 and the pump capacity, or may be a value calculated from the speeds of the boom cylinder 134, the arm cylinder 135, and the bucket cylinder 136.

The timing determination unit 1110 determines the swing start timing based on the required swing time specified by the swing time specification unit 1108 and the arrival time specified by the arrival time specification unit 1109. Specifically, when the arrival time becomes less than the required swing time, the timing determination unit 1110 determines this timing as the swing start timing. In addition, at the swing start timing, the tip of the arm 132 is positioned at a swing start position P11.

In a case where the operation signal input unit 1103 receives the input of the loading command signal, the operation signal generation unit 1111 generates the operation signal for moving the bucket 133 to the loading position P13 based on the loading position P13 specified by the loading position specification unit 1105, interference avoidance position P12 specified by the avoidance position specification unit 1106, and the swing start timing determined by the timing determination unit 1110. In other words, the operation signal generation unit 1111 generates the operation signal so as to reach the loading position P13 from the excavation completion position P10 via the swing start position P11 and the interference avoidance position P12. The operation signal generated by the operation signal generation unit 1111 includes an operation signal of the swing body 120 and an operation signal of the work equipment 130. The operation signal of the swing body 120 is a swing operation signal for driving the swing motor 129, and the operation signal of the work equipment 130 is an operation signal (of the work equipment) for operating the work equipment 130 by extending and contracting at least one of the boom cylinder 134, the arm cylinder 135, and the bucket cylinder 136. Further, the operation signal generation unit 1111 generates the operation signal for the bucket 133 such that a ground angle of the bucket 133 does not change even when the boom 131 and the arm 132 are driven. In addition, the operation signal generation unit 1111 generates an operation signal that causes a loading operation after reaching the loading position P13.

The operation signal output unit 1112 outputs the operation signal input to the operation signal input unit 1103 and the operation signal generated by the operation signal generation unit 1111 to the hydraulic device 127. In addition, the operation signal generation unit 1111 generates the operation signal of the work equipment 130 without generating the operation signal of the swing body 120 in a case of not reaching the swing start timing, and generates the operation signal of the swing body 120 and the operation signal of the work equipment 130 in a case of reaching the swing start timing. Therefore, the operation signal output unit 1112 outputs the operation signal of the work equipment 130 without outputting the operation signal of the swing body 120 in a case of not reaching the swing start timing, and outputs the operation signal of the swing body 120 and the operation signal of the work equipment 130 in a case of reaching the swing start timing.

<<Operation>>

When the operator of the loading machine 100 determines that the loading machine 100 and the loading object 200 are in a positional relationship that allows loading processing, the operator switches on the operation device 123. Accordingly, the operation device 123 generates and outputs a loading command signal.

Figure 4:
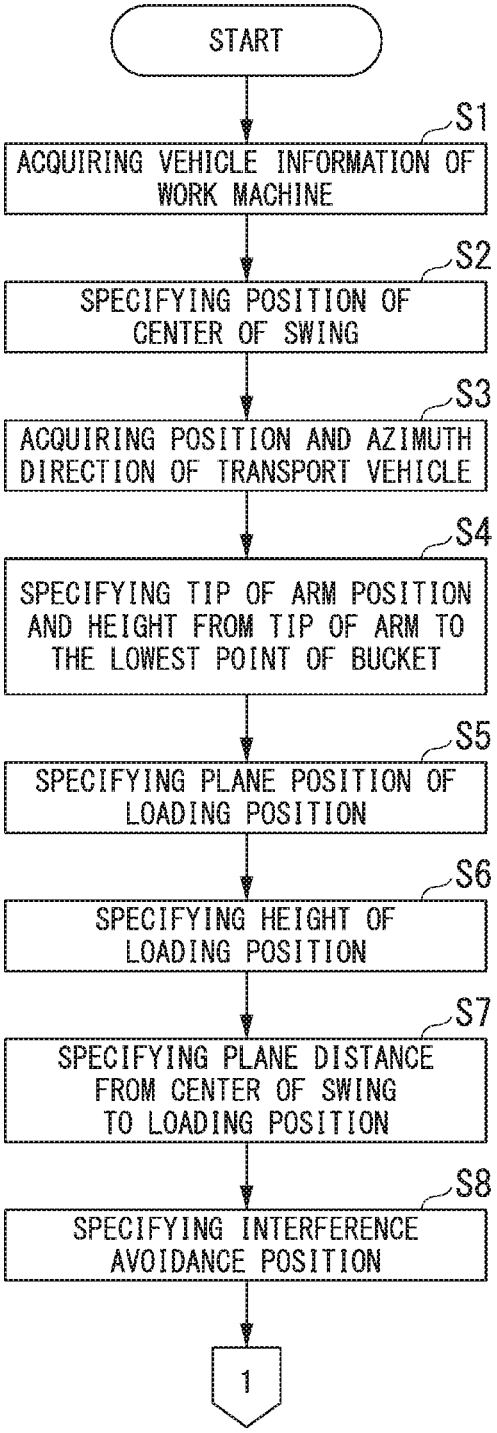
FIG. 4 is a flowchart showing an automatic loading control method according to the first embodiment.
Figure 5:
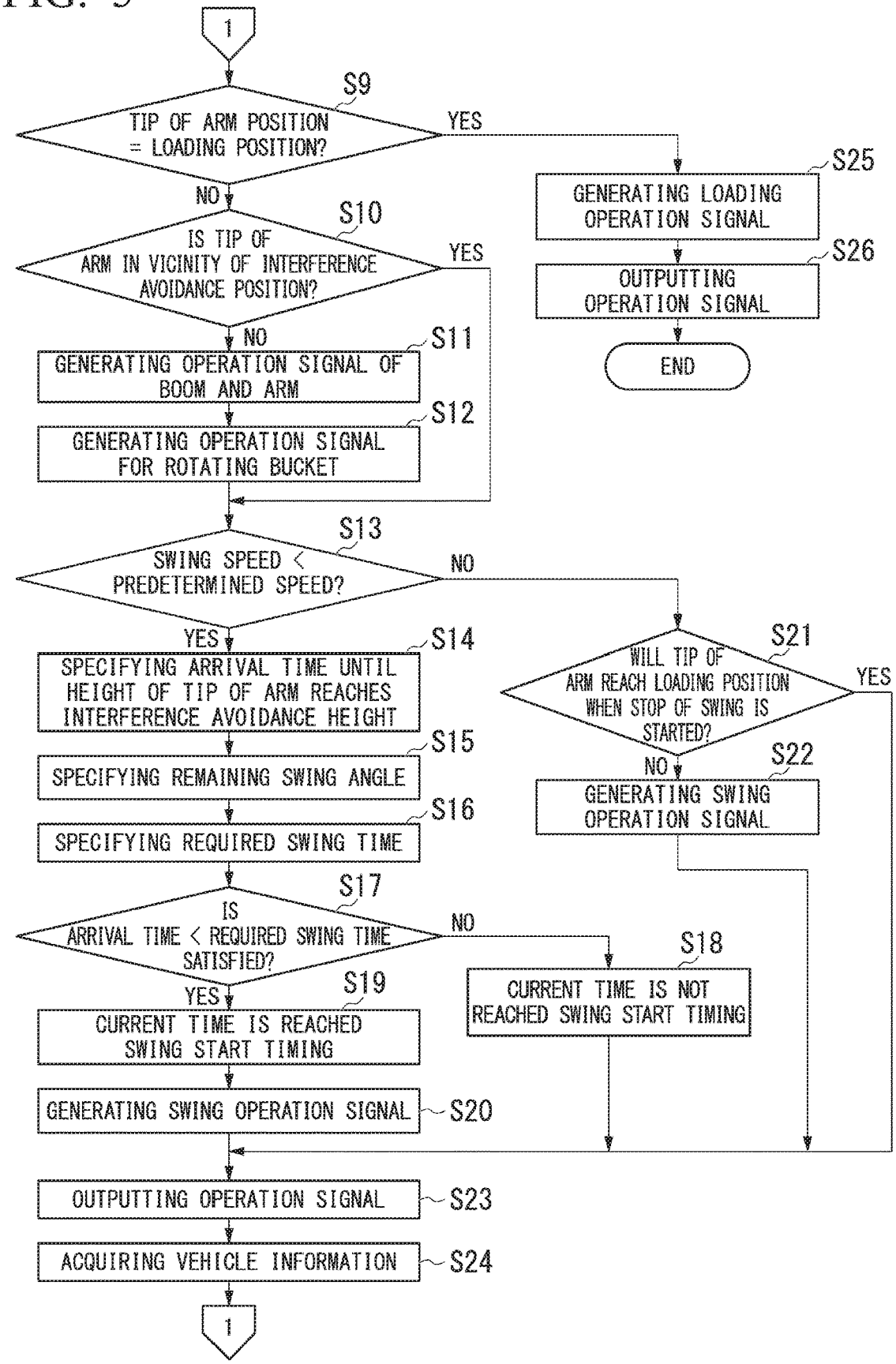
FIG. 5 is a flowchart showing the automatic loading control method according to the first embodiment.

FIGS. 4 and 5 are flowcharts showing an automatic loading control method according to the first embodiment. When the control device 128 receives the input of the loading command signal from the operator, the control device 128 executes the automatic loading control shown in FIGS. 4 and 5.

The vehicle information acquisition unit 1101 acquires the position and the azimuth direction of the swing body 120, the inclination angles of the boom 131, the arm 132, and the bucket 133, the attitude and the swing speed of the swing body 120 (step S1). The vehicle information acquisition unit 1101 specifies the position of the center of swing of the swing body 120 based on the acquired position and the azimuth direction of the swing body 120 (step S2). Then, the detection information acquisition unit 1102 acquires the three-dimensional position information of the loading object 200 from the detection device 124, and specifies the position and the shape of the loading object 200 from the three-dimensional position information (step S3).

Based on the vehicle information acquired by the vehicle information acquisition unit 1101, the bucket position specification unit 1104 specifies the position P of the tip of the arm 132 when the loading command signal is input, and the height Hb from the tip of the arm 132 to the lowest point of the bucket 133 (step S4). The bucket position specification unit 1104 specifies the position P as the excavation completion position P10.

The loading position specification unit 1105 converts the position information of the loading object 200 acquired by the detection information acquisition unit 1102 from the field coordinate system to the shovel coordinate system based on the position, the azimuth direction, and the attitude of the swing body 120 acquired in step S1. The loading position specification unit 1105 specifies the plane position of the loading position P13 based on the position and the shape of the loading object 200 specified by the detection information acquisition unit 1102 (step S5). At this time, the loading position specification unit 1105 specifies the height of the loading position P13 by adding the height Hb from the tip of the arm 132 specified in step S4 to the lowest point of the bucket 133 and the height for the control margin of the bucket 133, to the height Ht of the loading object 200 (step S6).

The avoidance position specification unit 1106 specifies the plane distance from the center of swing to the loading position P13 (step S7). The avoidance position specification unit 1106 specifies the position separated from the center of swing by the specified plane distance, that is, the position at which the outer shape of the bucket 133 does not interfere with the loading object 200 in a plan view and which is the closest to the loading position P13, as the interference avoidance position P12 (step S8).

The operation signal generation unit 1111 determines whether or not the position P of the tip of the arm 132 has reached the loading position P13 (step S9). In a case where the position of the tip of the arm 132 has not reached the loading position P13 (step S9: NO), the operation signal generation unit 1111 determines whether or not the position of the tip of the arm 132 is in the vicinity of the interference avoidance position P12 (step S10). For example, the operation signal generation unit 1111 determines whether or not a difference between the height of the tip of the arm 132 and the height of the interference avoidance position P12 is less than a predetermined threshold value, or a difference between the plane distance from the center of swing of the swing body 120 to the tip of the arm 132 and the plane distance from the center of swing to the interference avoidance position P12 is less than a predetermined threshold value (step S10).

In a case where the position of the tip of the arm 132 is not in the vicinity of the interference avoidance position P12 (step S10: NO), the operation signal generation unit 1111 generates the operation signals of the boom 131 and the arm 132 that move the tip of the arm 132 to the interference avoidance position P12 (step S11). At this time, the operation signal generation unit 1111 generates the operation signal based on the positions and speeds of the boom 131 and the arm 132. Further, in a case where the position P of the tip of the arm 132 is positioned in the vicinity of the interference avoidance position P12, the operation signal generation unit 1111 may decrease the operation amount according to a predetermined change rate in order to reduce the impact applied to the work equipment 130 during braking. The change rate of the operation amount is a value that corresponds to a change rate $a_w$.

In addition, the operation signal generation unit 1111 calculates the sum of the angular velocities of the boom 131 and the arm 132 based on the generated operation signals of the boom 131 and the arm 132 and generates the operation signal for rotating the bucket 133 at the same speed as the sum of the angular velocities (step S12). Accordingly, the operation signal generation unit 1111 can generate the operation signal for holding the ground angle of the bucket 133. In another embodiment, the operation signal generation unit 1111 may generate the operation signal for rotating the bucket 133 such that the ground angle of the bucket 133 obtained by calculating from the detected values of the boom angle sensor 137, the arm angle sensor 138, and the bucket angle sensor 139 becomes equal to the ground angle when the automatic control is started.

In a case where the position of the tip of the arm 132 is in the vicinity of the interference avoidance position P12 (step S10: YES), the operation signal generation unit 1111 does not generate the operation signal for driving the work equipment 130. In other words, the operation signals of the boom 131, the arm 132, and the bucket 133 are not generated.

The operation signal generation unit 1111 determines whether or not the swing speed of the swing body 120 is lower than a predetermined speed based on the vehicle information acquired by the vehicle information acquisition unit 1101 (step S13). In other words, the operation signal generation unit 1111 determines whether or not the swing body 120 is swinging.

In a case where the swing speed of the swing body 120 is lower than the predetermined speed (step S13: YES), the arrival time specification unit 1109 specifies the arrival time until the height of the tip of the arm 132 reaches the height of the interference avoidance position P12 (step S14). Next, the remaining swing angle specification unit 1107 specifies the remaining swing angle formed by the straight line that extends from the center of swing to the tip of the arm 132 and the straight line that extends from the center of swing to the interference avoidance position P12 based on the center of swing specified in step S2 (step S15). The swing time specification unit 1108 specifies the required swing time required to swing the swing body by the remaining swing angle specified by the remaining swing angle specification unit 1107 (step S16). Next, the timing determination unit 1110 determines whether or not the arrival time specified by the arrival time specification unit 1109 is less than the required swing time specified by the swing time specification unit 1108 (step S17).

In a case where the arrival time is equal to or greater than the required swing time (step S17: NO), the timing determination unit 1110 determines that a current time is not reached the swing start timing (step S18). In a case where the current time is not reached the swing start timing, the operation signal generation unit 1111 does not generate the swing operation signal.

On the other hand, in a case where the arrival time is less than the required swing time (step S17: YES), the timing determination unit 1110 determines that the current time is reached the swing start timing (step S19). In a case where the current time is reached the swing start timing, the operation signal generation unit 1111 generates the swing operation signal (step S20).

In a case where the swing speed of the swing body 120 is equal to or higher than the predetermined speed (step S13: NO), the operation signal generation unit 1111 determines whether or not the tip of the arm 132 will reach the loading position P13 in a case where the output of the swing operation signal is stopped at the current time (step S21). The swing body 120 continues to swing due to inertia while decelerating after stopping the output of the swing operation signal, and then stops. In a case where the output of the swing operation signal is stopped at the current time, and in a case where the tip of the arm 132 will reach the loading position P13 (step S21: YES), the operation signal generation unit 1111 does not generate the swing operation signal. Accordingly, the swing body 120 starts decelerating.

On the other hand, in a case where the output of the swing operation signal is stopped at the current time, and in a case where the tip of the arm 132 will stop before the loading position P13 (step S21: NO), the operation signal generation unit 1111 generates the swing operation signal (step S22).

When at least one of the operation signals of the boom 131, the arm 132, and the bucket 133 and the swing operation signal of the swing body 120 is generated by the processing from step S9 to step S22, the operation signal output unit 1112 outputs the generated operation signal to the hydraulic device 127 (step S23). Then, the vehicle information acquisition unit 1101 acquires the vehicle information (step S24). Accordingly, the vehicle information acquisition unit 1101 can acquire the vehicle information after being driven by the output operation signal. The control device 128 returns the process to step S9, and repeatedly executes generation of the operation signal.

On the other hand, in step S9, in a case where the position of the tip of the arm 132 has reached the loading position P13 (step S9: YES), the operation signal generation unit 1111 does not generate the operation signal. Therefore, when the position of the tip of the arm 132 reaches the loading position P13, the work equipment 130 and the swing body 120 are stopped. In a case where the position of the tip of the arm 132 has reached the loading position P13 (step S9: YES), that is, in a case where the operation signal generation unit 1111 has not generated the operation signal in the processing from step S9 to step S22, and the work equipment 130 and the swing body 120 are stationary, the operation signal generation unit 1111 generates the operation signal for causing the bucket 133 to perform the loading operation (step S25). Examples of the operation signal for causing the bucket 133 to perform the loading operation include an operation signal for rotating the bucket 133 in a dumping direction and an operation signal for opening the clam shell in a case where the bucket 133 is a clam bucket. The operation signal output unit 1112 outputs the generated operation signal to the hydraulic device 127 (step S26). Then, the control device 128 ends the automatic loading control.

Figure 6:
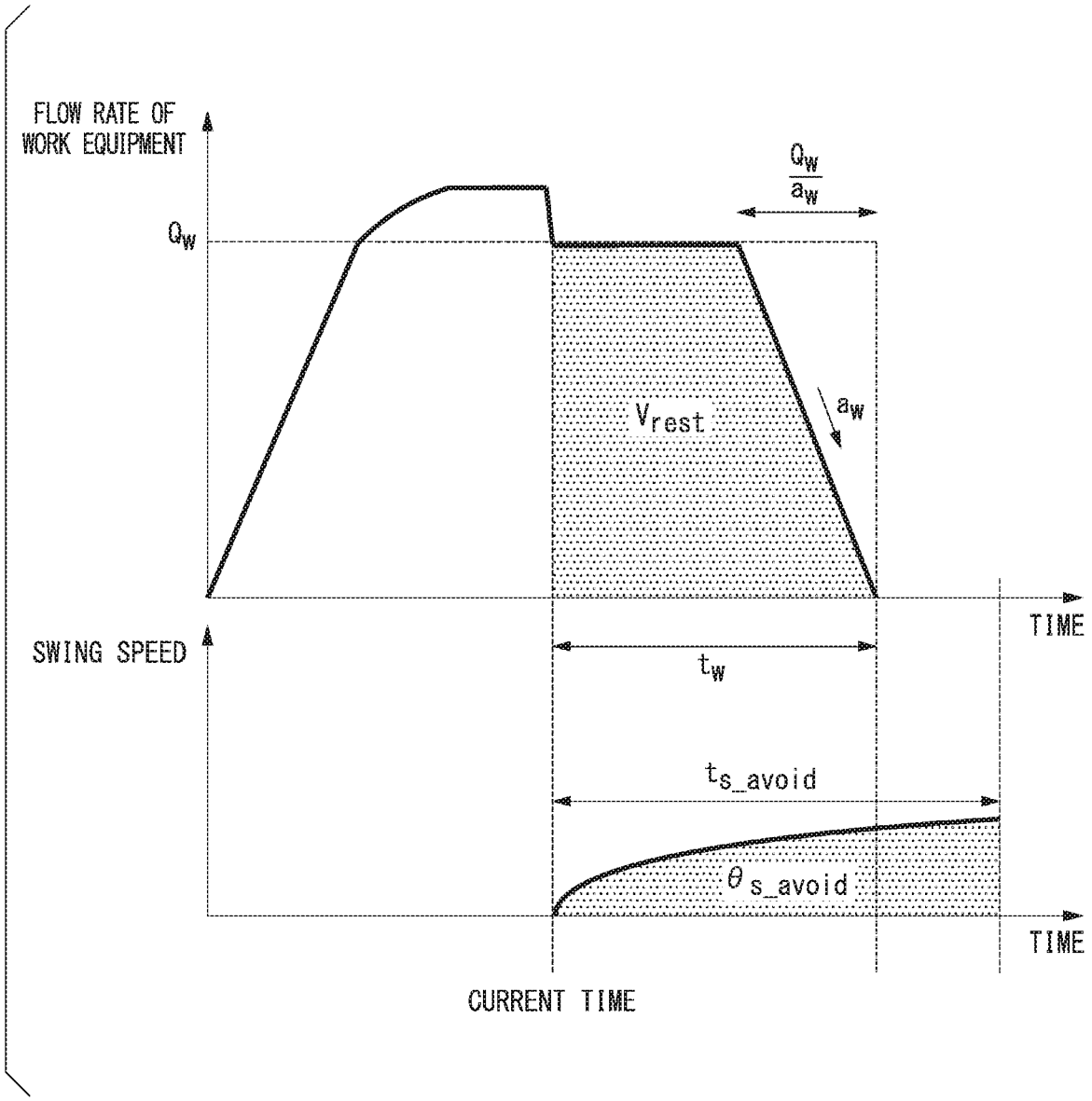
FIG. 6 is a diagram showing a relationship between an arrival time and a required swing time.

Here, an operation of the loading machine 100 at the time of the automatic loading control will be described using FIGS. 3 and 6. FIG. 6 is a diagram showing a relationship between the arrival time and the required swing time.

When the automatic loading control is started, the boom 131 and the arm 132 rises from the excavation completion position P10 toward the swing start position P11. At this time, the bucket 133 is driven so as to maintain the ground angle at the end of excavation.

As shown in FIG. 6, the arrival time specification unit 1109 specifies an arrival time $t_w$ up to the height of the interference avoidance position P12, the swing time specification unit 1108 specifies a required swing time $t_{s_avoid}$, and the timing determination unit 1110 determines whether or not the arrival time $t_w$ becomes less than the required swing time $t_{s_avoid}$. The required swing time $t_{s_avoid}$ is the time required for the swing body 120 to swing by the remaining swing angle $\theta_{s_avoid}$ as shown in FIG. 6.

As shown in FIG. 6, the arrival time $t_w$ can be obtained based on a volume $V_{rest}$ of the hydraulic oil that needs to be supplied to the work equipment 130 in order for the tip of the arm 132 to reach the height of the interference avoidance position P12, a maximum flow rate $Q_w$ (first-order differential value of volume) of the hydraulic oil supplied to the work equipment 130 when the work equipment 130 and the swing body 120 are operated, and a change rate $a_w$ (second-order differential value of volume) of the flow rate set to suppress an impact at the time of stopping. Specifically, the arrival time $t_w$, the volume $V_{rest}$ of the hydraulic oil, the maximum flow rate $Q_w$ of the hydraulic oil, and the change rate $a_w$ of the flow rate satisfy the following equation (1).

$$V_{rest}+(Q_w^2/2a_w)=Q_w t_w \quad (1)$$

When the arrival time $t_w$ becomes less than the required swing time $t_{s_avoid}$, it is specified that the tip of the arm 132 has reached the swing start position P11, and the swing body 120 starts swinging toward the loading position P13. At this time, since the tip of the arm 132 has not reached the height of the interference avoidance position P12, the boom 131 and the arm 132 continue to rise. At this time, as shown in FIG. 3, in a case where the distance from the center of swing to the tip (position P10*a*, position P10*b*) of the arm 132 is different from the distance from the center of swing to the interference avoidance position P12, the control device 128 also moves the work equipment 130 in a swing radius direction such that the distance from the center of swing to the tip of the arm 132 becomes equal to the distance from the center of swing to the interference avoidance position P12. While the tip of the arm 132 moves from the swing start position P11 to the interference avoidance position P12, the boom 131, the arm 132, and the bucket 133 are decelerated such that the height of the tip of the arm 132 becomes equal to the interference avoidance position P12.

When the tip of the arm 132 comes to the interference avoidance position P12, the driving of the work equipment 130 stops. Meanwhile, the swing body 120 continues swinging. In other words, between the interference avoidance position P12 and the loading position P13, the tip of the arm 132 moves only by swinging the swing body 120 without driving the work equipment 130. While the tip of the arm 132 moves from the swing start position P11 to the loading position P13, the swing body 120 is decelerated such that the position of the tip of the arm 132 becomes equal to the loading position P13.

When the tip of the arm 132 comes to the loading position P13, the driving of the work equipment 130 and the swing body 120 stops. Thereafter, the bucket 133 executes the loading operation.

By the above-described automatic loading control, the loading machine 100 can automatically load the earth scooped by the bucket 133 onto the loading object 200. The operator repeatedly executes excavation by the work equipment 130 and the automatic loading control by inputting the loading command signal such that the loading amount of the loading object 200 does not exceed the maximum loading amount.

Action and Effect

The control device 128 of the loading machine 100 according to the first embodiment determines the swing start timing based on the remaining swing angle up to the interference avoidance position P12 and the height of the interference avoidance position P12. The control device 128 outputs the operation signal of the work equipment 130 without outputting the operation signal of the swing body 120 in a case where the current time is not reached the swing start timing. Meanwhile, the control device 128 outputs the operation signal of the swing body 120 and the operation signal of the work equipment 130 in a case where the current time is reached the swing start timing.

When the position of the work equipment 130 in a plan view from above reaches the interference avoidance position P12 before the work equipment 130 rises to the height of the interference avoidance position P12, there is a possibility that the work equipment 130 hits the side surface of the loading object 200. Therefore, the control device 128 controls the swing start timing such that the position of the work equipment 130 in a plan view from above does not reach the interference avoidance position P12 before the work equipment 130 rises to the height of the interference avoidance position P12 by the above-described control, and accordingly, the work equipment 130 can be prevented from hitting the loading object 200.

Second Embodiment

The control device 128 according to the first embodiment determines the swing start timing based on the required swing time required for swinging the swing body by the remaining swing angle and the arrival time until the height of the work equipment 130 reaches the height of the interference avoidance position P12. On the other hand, in a second embodiment, the swing start timing is determined by another method.

<<Configuration of Control Device>>

Figure 7:
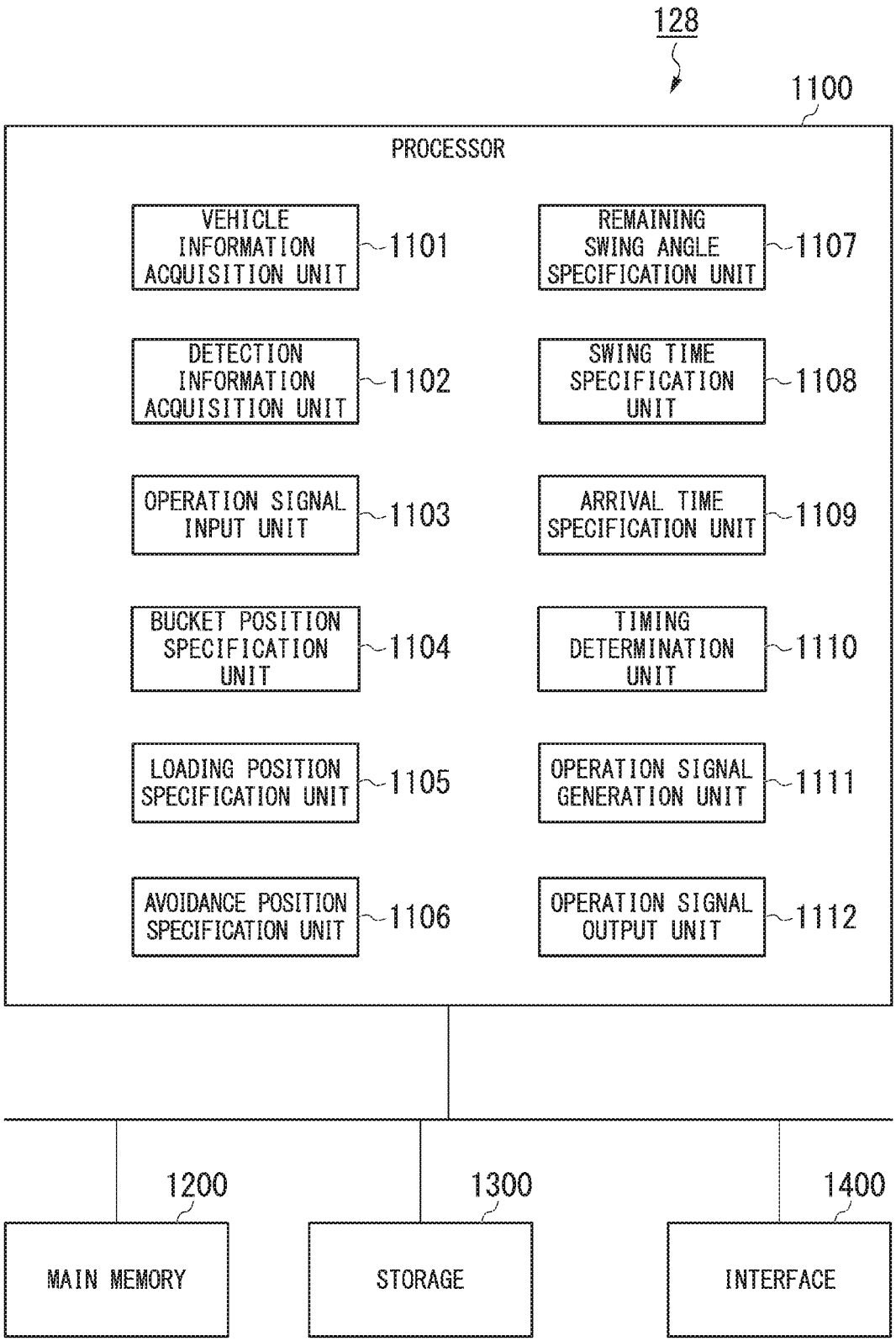
FIG. 7 is a schematic block diagram showing a configuration of a control device according to a second embodiment.

FIG. 7 is a schematic block diagram showing a configuration of the control device according to the second embodiment.

The control device 128 according to the second embodiment includes an angle estimation unit 1113 instead of the swing time specification unit 1108 in the configuration of the first embodiment. Moreover, the timing determination unit 1110 according to the second embodiment determines the swing start timing by the method different from that of the first embodiment.

The angle estimation unit 1113 specifies the estimated swing angle at which the swing can be made for the arrival time specified by the arrival time specification unit 1109. For example, the angle estimation unit 1113 models the swing of the swing body 120 in advance, and specifies the estimated swing angle based on the acceleration of the swing body 120 when the operation signal for operating the swing body 120 with the maximum operation amount is output, and the highest angular velocity of the swing body 120. In addition, the angle estimation unit 1113 may specify the estimated swing angle with reference to a table in which the arrival time and the estimated swing angle are associated with each other in advance.

The timing determination unit 1110 determines the swing start timing based on the remaining swing angle specified by the remaining swing angle specification unit 1107 and the estimated swing angle specified by the angle estimation unit 1113. Specifically, when the estimated swing angle is less than the remaining swing angle, the timing determination unit 1110 determines this timing as the swing start timing.

<<Operation>>

Figure 8:
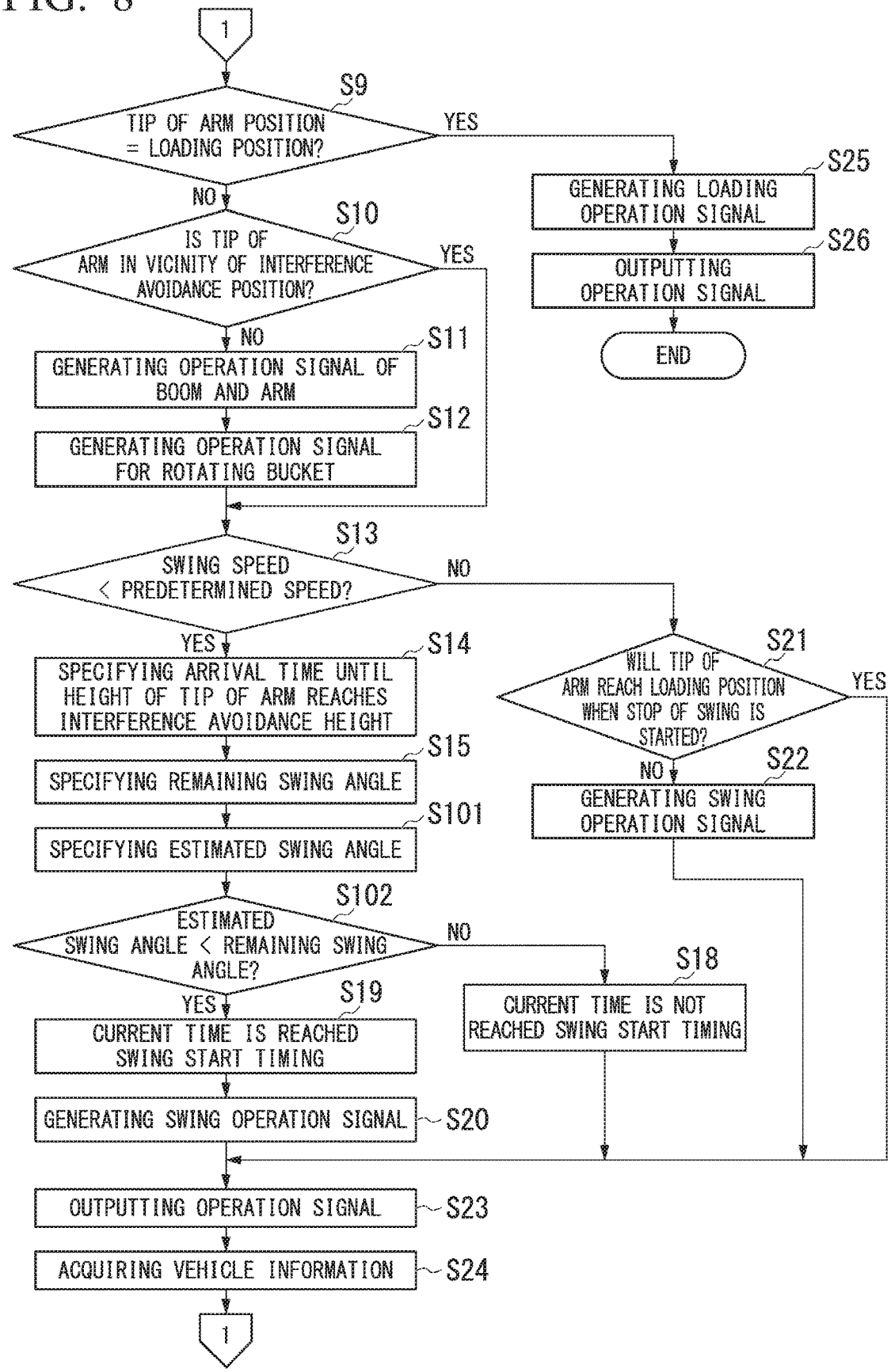
FIG. 8 is a flowchart showing an operation of the control device according to the second embodiment.

FIG. 8 is a flowchart showing an operation of the control device according to the second embodiment.

The control device 128 according to the second embodiment executes the following steps S101 and S102 instead of steps S16 and S17 in the first embodiment.

When the remaining swing angle specification unit 1107 specifies the remaining swing angle in step S15, the angle estimation unit 1113 specifies the estimated swing angle that can be swinged for the arrival time specified by the arrival time specification unit 1109 in step S14 (step S101). Next, the timing determination unit 1110 determines whether or not the estimated swing angle is smaller than the remaining swing angle (step S102).

In a case where the estimated swing angle is equal to or greater than the remaining swing angle (step S102: NO), the timing determination unit 1110 determines that the current time is not reached the swing start timing (step S18). On the other hand, in a case where the estimated swing angle is smaller than the remaining swing angle (step S102: YES), the timing determination unit 1110 determines that the current time is reached the swing start timing (step S19).

Thereafter, the control device 128 executes the same processing as that in the first embodiment.

Action and Effect

As described above, similar to the first embodiment, the control device 128 of the loading machine 100 according to the second embodiment controls the swing start timing such that the position of the work equipment 130 in a plan view from above does not reach the interference avoidance position P12 before the work equipment 130 rises to the height of the interference avoidance position P12, and accordingly, the work equipment 130 can be prevented from hitting the loading object 200.

Third Embodiment

In a third embodiment, the swing start timing is determined by the method different from those in the first and second embodiments.

<<Configuration of Control Device>>

Figure 9:
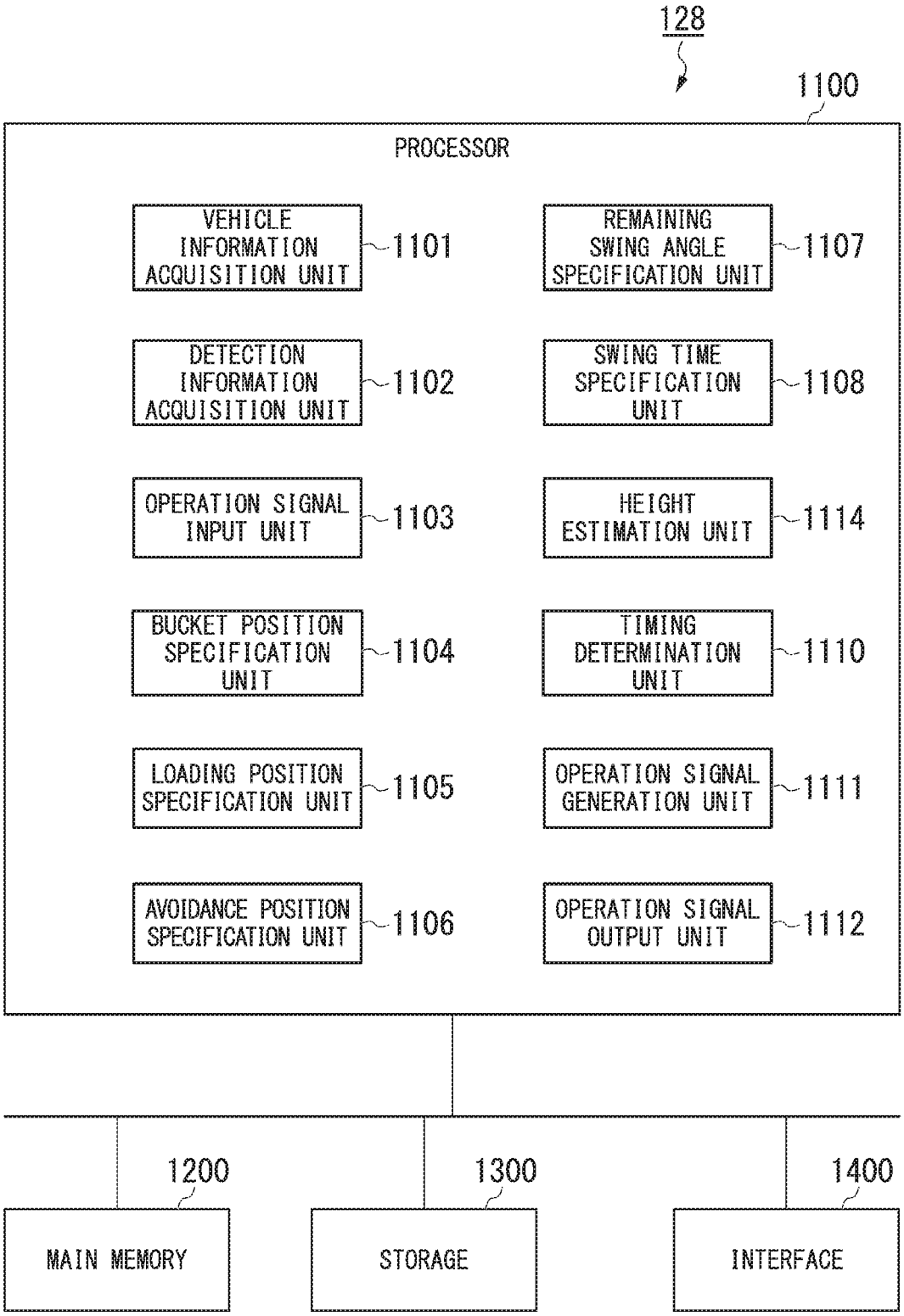
FIG. 9 is a schematic block diagram showing a configuration of a control device according to a third embodiment.

FIG. 9 is a schematic block diagram showing a configuration of the control device according to the third embodiment.

The control device 128 according to the third embodiment includes a height estimation unit 1114 instead of the arrival time specification unit 1109 in the configuration of the first embodiment. Moreover, the timing determination unit 1110 according to the third embodiment determines the swing start timing by the method different from that of the first embodiment.

The height estimation unit 1114 specifies an estimated bucket height at which the bucket 133 can rise in the required swing time specified by the swing time specification unit 1108. For example, the height estimation unit 1114 models the operation of the work equipment 130 in advance and specifies the estimated bucket height based on the speed of rise of the work equipment 130 when the operation signal for operating the work equipment 130 with the maximum operation amount is output. In addition, the height estimation unit 1114 may specify the estimated bucket height with reference to a table in which the swing time and the estimated bucket height are associated with each other in advance.

The timing determination unit 1110 determines the swing start timing based on the height of the interference avoidance position P12 specified by the avoidance position specification unit 1106 and the estimated bucket height specified by the height estimation unit 1114. Specifically, when the estimated bucket height is equal to or higher than the interference avoidance position P12, the timing determination unit 1110 determines this timing as the swing start timing.

<<Operation>>

Figure 10:
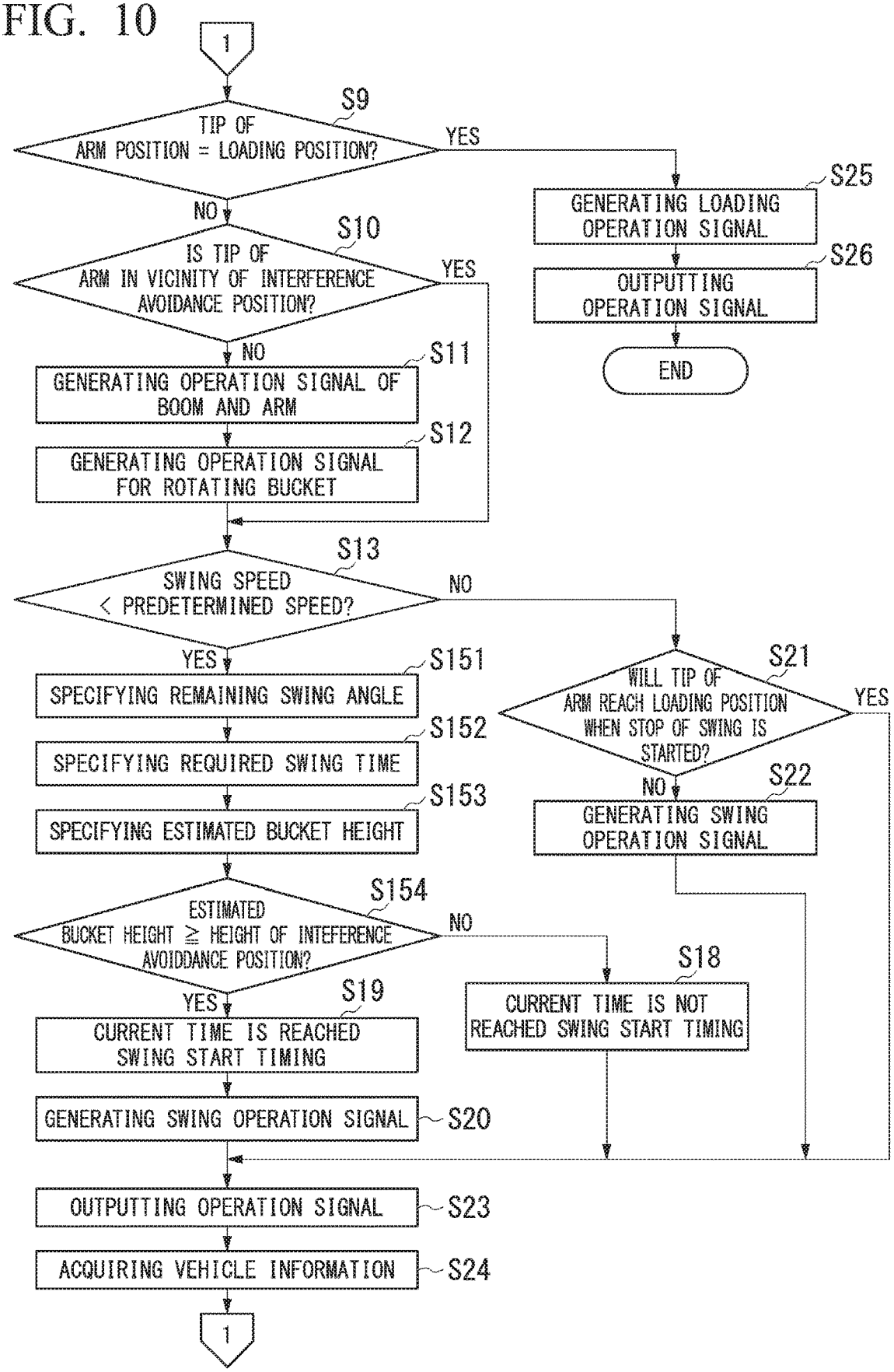
FIG. 10 is a flowchart showing an operation of the control device according to the third embodiment.

FIG. 10 is a flowchart showing an operation of the control device according to the third embodiment.

The control device 128 according to the third embodiment executes the following steps S151 and S154 instead of steps S14 to S17 in the first embodiment.

In step S13, in a case where it is determined that the swing speed of the swing body 120 is lower than a predetermined speed (step S13: YES), the remaining swing angle specification unit 1107 specifies the remaining swing angle formed by the straight line that extends from the center of swing to the tip of the arm 132 and the straight line that extends from the center of swing to the interference avoidance position P12 based on the center of swing specified in step S2 (step S151). The swing time specification unit 1108 specifies the required swing time required for swinging the swing body by the remaining swing angle specified by the remaining swing angle specification unit 1107 (step S152). The height estimation unit 1114 specifies an estimated bucket height at which the bucket 133 can rise for the required swing time specified by the swing time specification unit 1108 (step S153).

Next, the timing determination unit 1110 determines whether or not the estimated bucket height specified by the height estimation unit 1114 is equal to or higher than the height of the interference avoidance position P12 (step S154). In a case where the estimated bucket height is lower than the height of the interference avoidance position P12 (step S154: NO), the timing determination unit 1110 determines that the current time is not reached the swing start timing (step S18). On the other hand, in a case where the estimated bucket height is equal to or higher than the height of the interference avoidance position P12 (step S154: YES), the timing determination unit 1110 determines that the current time is reached the swing start timing (step S19).

Thereafter, the control device 128 executes the same processing as that in the first embodiment.

Action and Effect

As described above, similar to the first and second embodiments, the control device 128 of the loading machine 100 according to the third embodiment controls the swing start timing such that the position of the work equipment 130 in a plan view from above does not reach the interference avoidance position P12 before the work equipment 130 rises to the height of the interference avoidance position P12, and accordingly, the work equipment 130 can be prevented from hitting the loading object 200.

Fourth Embodiment

The control device 128 according to the first to third embodiments continuously calculates the remaining swing angle from the timing when the input of the loading command signal is received to the swing start timing, and based on the calculated remaining swing angle, the swing start timing is determined. On the other hand, the control device 128 according to a fourth embodiment determines the swing start timing in advance when receiving the input of the loading command signal from the operator.

<<Configuration of Control Device>>

Figure 11:
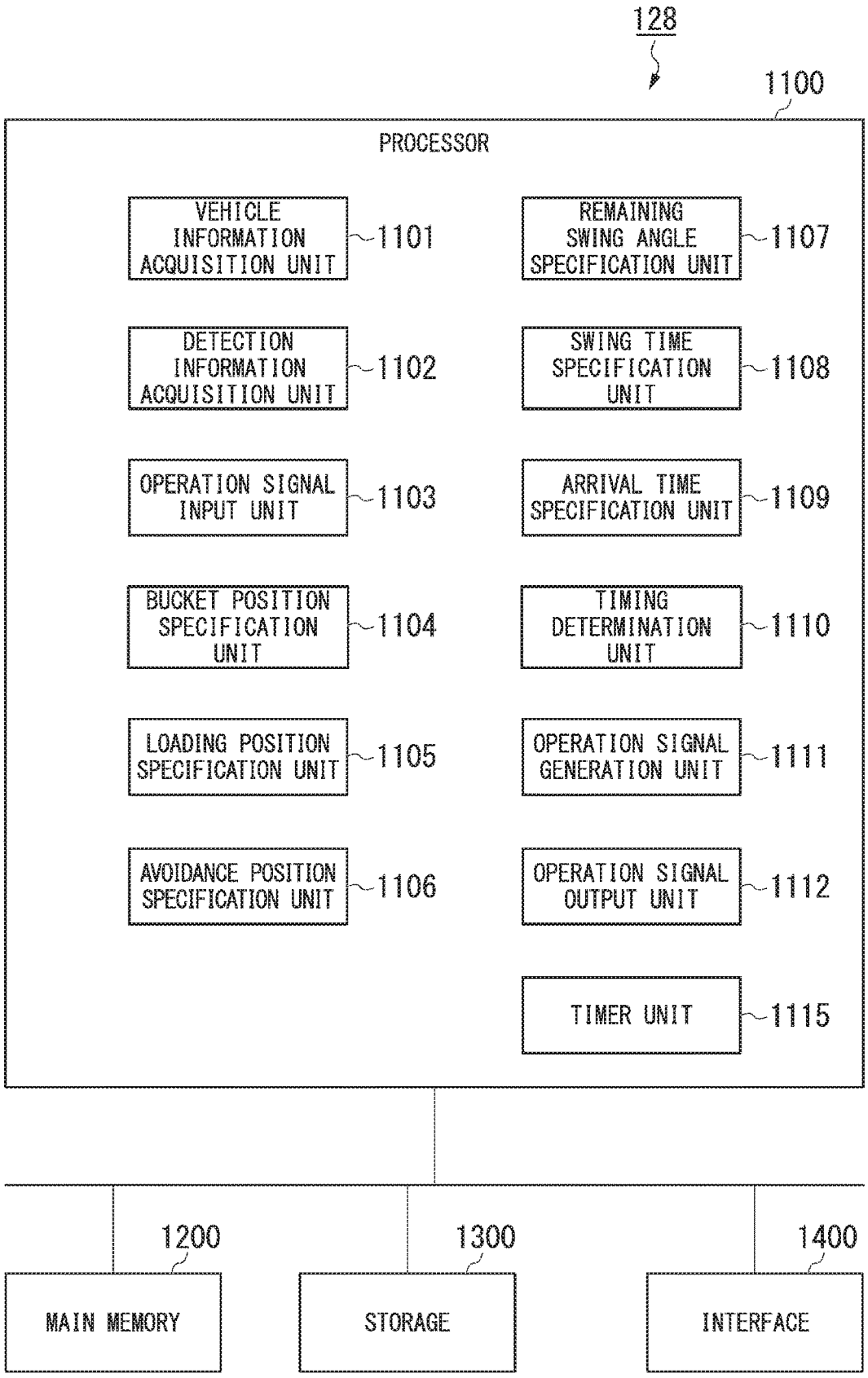
FIG. 11 is a schematic block diagram showing a configuration of a control device according to a fourth embodiment.

FIG. 11 is a schematic block diagram showing a configuration of the control device according to the fourth embodiment.

The control device 128 according to the fourth embodiment further includes a timer unit 1115 in addition to the configuration of the first embodiment. Moreover, the timing determination unit 1110 according to the fourth embodiment determines the swing start timing by the method different from that of the first embodiment.

The timer unit 1115 measures time. In other words, the control device 128 can specify the current time with reference to the timer unit 1115.

When the input of the loading command signal has been received, the timing determination unit 1110 determines the swing start timing based on the arrival time specified by the arrival time specification unit 1109 and the required swing time specified by the swing time specification unit 1108. Specifically, the timing determination unit 1110 determines a timing after passing time that corresponds to the difference between the arrival time and the required swing time as the swing start timing from the timing when the input of the loading command signal is received.

The timing determination unit 1110 compares the timing measured by the timer unit 1115 with the swing start timing, and determines whether or not the current time is reached the swing start timing.

<<Operation>>

Figure 12:
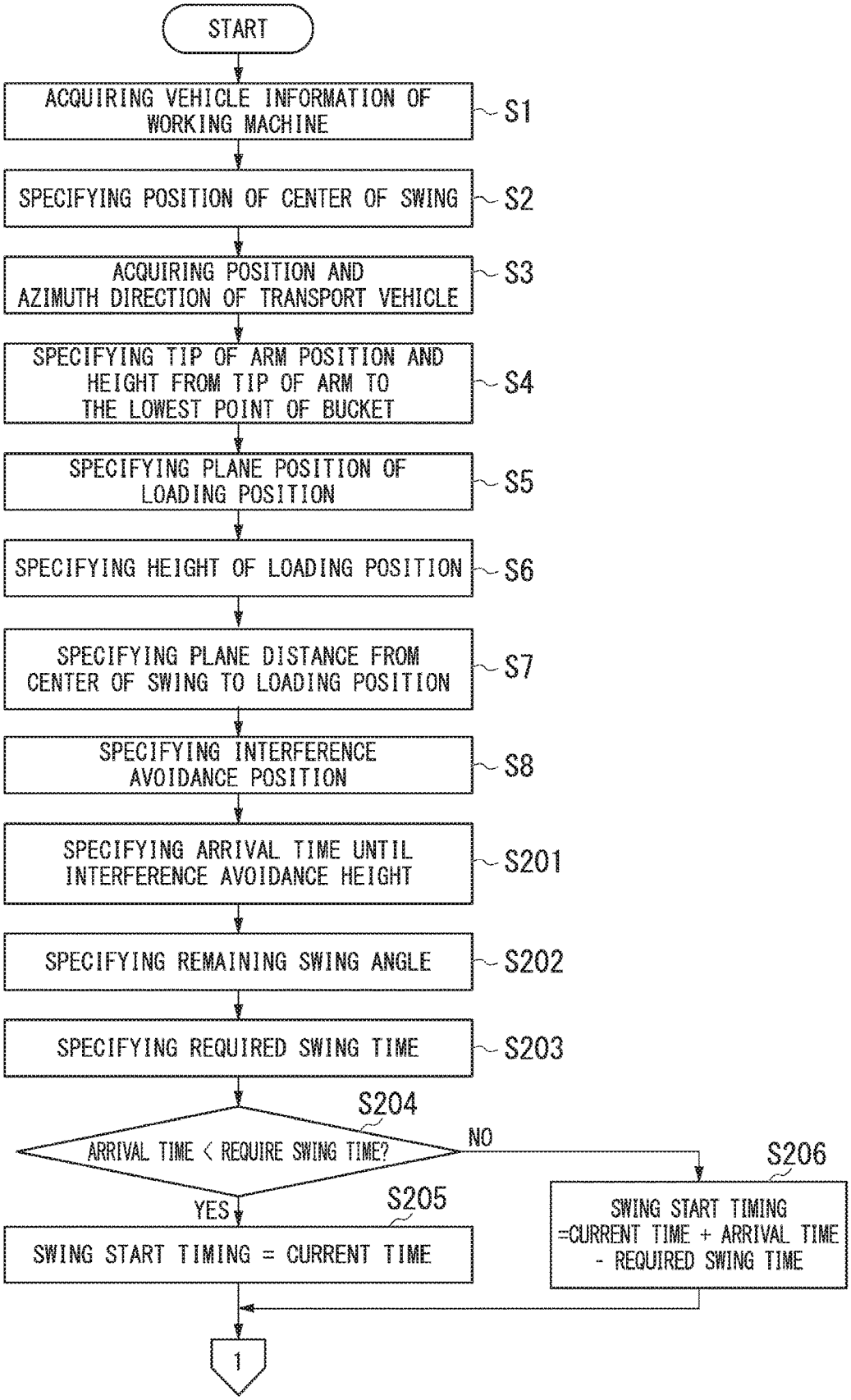
FIG. 12 is a flowchart showing an operation of the control device according to the fourth embodiment.
Figure 13:
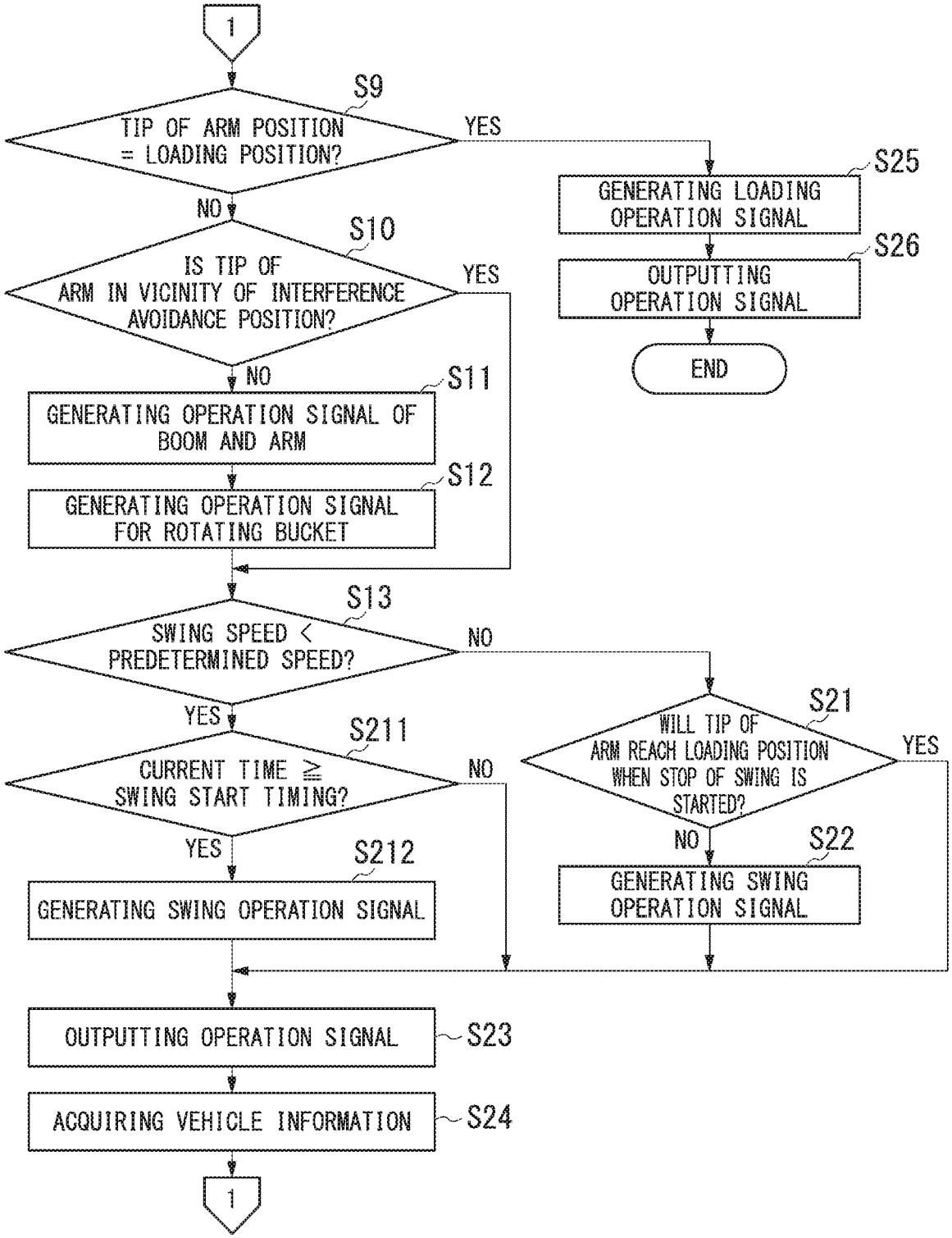
FIG. 13 is a flowchart showing an operation of the control device according to the fourth embodiment.

FIGS. 12 and 13 are flowcharts showing the operation of the control device according to the fourth embodiment.

The control device 128 according to the fourth embodiment further executes the processing of steps S201 and S206 between steps S8 and S9 in the first embodiment.

In step S8, when the avoidance position specification unit 1106 specifies the interference avoidance position P12, the arrival time specification unit 1109 specifies the arrival time until the height of the tip of the arm 132 reaches the height of the interference avoidance position P12 (step S201). Next, the remaining swing angle specification unit 1107 specifies the remaining swing angle formed by the straight line that extends from the center of swing to the tip of the arm 132 and the straight line that extends from the center of swing to the interference avoidance position P12 based on the center of swing specified in step S2 (step S202). The swing time specification unit 1108 specifies the required swing time required for swinging the swing body by the remaining swing angle specified by the remaining swing angle specification unit 1107 (step S203). Next, the timing determination unit 1110 determines whether or not the arrival time specified by the arrival time specification unit 1109 is less than the required swing time specified by the swing time specification unit 1108 (step S204).

In a case where the arrival time is less than the required swing time (step S204: YES), the timing determination unit 1110 determines that the current time as the swing start timing (step S205). This is because, even when the swing body 120 is swinged immediately after receiving the input of the loading command signal, the work equipment 130 rises up to the height of the interference avoidance position P12 before the position of the work equipment 130 in a plan view from above reaches the interference avoidance position P12.

On the other hand, in a case where the arrival time is equal to or greater than the required swing time (step S204: NO), the timing determination unit 1110 determines the timing after passing the time that corresponds to the difference between the arrival time and the required swing time from the current time as the swing start timing (step S206).

Thereafter, the control device 128 executes the same processing as that in the first embodiment in steps S9 to S13.

In step S13, in a case where the swing speed of the swing body 120 is lower than the predetermined speed (step S13: YES), the timing determination unit 1110 determines whether or not the current time is reached the swing start timing with reference to the timing measured by the timer unit 1115 (step S211).

In a case where the current time is not reached the swing start timing (step S211: NO), the operation signal generation unit 1111 does not generate the swing operation signal.

On the other hand, in a case where the current time is reached the swing start timing (step S211: YES), the operation signal generation unit 1111 generates the swing operation signal (step S212).

In step S13, the processing in a case where the swing speed of the swing body 120 is equal to or higher than the predetermined speed (step S13: NO) and the processing after step S23 are the same as those in the first embodiment.

Action and Effect

As described above, similar to the first to third embodiments, the control device 128 of the loading machine 100 according to the fourth embodiment controls the swing start timing such that the position of the work equipment 130 in a plan view from above does not reach the interference avoidance position P12 before the work equipment 130 rises to the height of the interference avoidance position P12, and accordingly, the work equipment 130 can be prevented from hitting the loading object 200.

In addition, similar to the first embodiment, the control device 128 according to the fourth embodiment determines the swing start timing based on the arrival time and the required swing time, but is not limited thereto. For example, when the control device 128 according to another embodiment receives the input of the loading command signal, the control device 128 may determine the swing start timing based on the estimated bucket height and the interference avoidance position similar to the third embodiment.

Other Embodiments

Above, the embodiment has been described in detail with reference to the drawings, but the specific configuration is not limited to the above-described configuration, and various design changes can be made.

For example, the loading machine 100 according to the above-described embodiment specifies the loading position P13 and the interference avoidance position P12 based on the three-dimensional position of the loading object 200 detected by the detection device 124, but is not limited thereto. For example, the loading machine 100 according to another embodiment may specify the loading position P13 and the interference avoidance position P12 based on the coordinates of the loading object 200 input by the operator. In a case where the loading machine 100 includes an input device, such as a touch panel, in the driver seat 122, the control device 128 may specify the loading position P13 and the interference avoidance position P12 as the operator inputs the coordinates of the loading object 200 to the input device. For example, the loading machine 100 according to another embodiment may store the loading operation with respect to the first loading object 200 by a manual operation of the operator, and specify the loading position P13 and the interference avoidance position P12 based on the loading operation.

In another embodiment, in a case where the loading object 200 is fixed, the loading machine 100 may specify the loading position P13 and the interference avoidance position P12 based on the position of the known loading object 200. For example, in a case where the loading object 200 is a transport vehicle having a vehicle position specifying function, such as GNSS, the loading machine 100 may acquire information indicating the position and azimuth direction from the loading object 200 stopped at a loading place and may specify the loading position P13 and the interference avoidance position P12 based on the information.

In addition, the control device 128 according to another embodiment may store the swing start timing in advance in association with the height or model number of the loading object 200 and the remaining swing angle when the input of the loading command signal is received and may determine the swing start timing based on the height or model number of the loading object 200 and the remaining swing angle when the input of the loading command signal is received.

Moreover, the control device 128 according to another embodiment may specify the swing start timing as the height of the work equipment 130 when starting swinging. For example, the control device 128 may store in advance the height of the work equipment 130 when starting swinging in association with the remaining swing angle when the input of the loading command signal is received, and may start the swing of the swing body 120 when the height of the work equipment 130 becomes the height associated with the remaining swing angle.

Moreover, although the control device 128 according to the above-described embodiments does not make the swing body 120 swing before the swing start timing, but is not limited thereto. For example, the control device 128 according to another embodiment may swing the swing body 120 at a low speed before the swing start timing. In other words, the control device 128 may swing the swing body 120 at a swing speed higher than that before the swing start timing, after the swing start timing.

INDUSTRIAL APPLICABILITY

The control device can control automatic loading in view of the outer shell of the loading object.

REFERENCE SIGNS LIST

100 . . . Loading Machine
110 . . . Traveling Body
120 . . . Swing Body
121 . . . Cab
122 . . . Driver Seat
123 . . . Operation Device
124 . . . Detection Device
125 . . . Position and Azimuth Direction Calculator
126 . . . Inclination Measuring Device
127 . . . Hydraulic Device
128 . . . Control Device
130 . . . Work Equipment
1101 . . . Vehicle Information Acquisition Unit
1102 . . . Detection Information Acquisition Unit
1103 . . . Operation Signal Input Unit
1104 . . . Bucket Position Specification Unit
1105 . . . Loading Position Specification Unit
1106 . . . Avoidance Position Specification Unit
1107 . . . Remaining Swing Angle Specification Unit
1108 . . . Swing Time Specification Unit
1109 . . . Arrival Time Specification Unit
1110 . . . Timing Determination Unit
1111 . . . Operation Signal Generation Unit
1112 . . . Operation Signal Output Unit
1113 . . . Angle Estimation Unit
1114 . . . Height Estimation Unit
1115 . . . Timer Unit

The invention claimed is:

1. A control device for controlling a loading machine including a swing body that swings around a center of swing and a work equipment that is attached to the swing body and has a bucket, the control device comprising:

an avoidance position specification unit that is configured to specify an interference avoidance position which is a bucket position that is higher than a loading object and has no loading object therebelow;

a timing determination unit that is configured to determine a swing start timing based on a remaining swing angle and a height of the interference avoidance position, the remaining swing angle being formed by a straight line that extends from the center of swing to the work equipment and a straight line that extends from the center of swing to the interference avoidance position in a plan view from above; and an operation signal output unit that is configured to output an operation signal of the work equipment in a case of not reaching the swing start timing, and output an operation signal for swinging the swing body at swing speed higher than that when not reaching the swing start timing and an operation signal of the work equipment, in a case of reaching the swing start timing.

2. The control device according to claim 1, further comprising:

a swing time specification unit that is configured to specify a required swing time required for swinging the swing body by the remaining swing angle; and an arrival time specification unit that specifies an arrival time until a height of the bucket position reaches the height of the interference avoidance position, wherein the timing determination unit determines the swing start timing based on the arrival time and the required swing time.

3. The control device according to claim 1, further comprising:

an arrival time specification unit that is configured to specify an arrival time until a height of the bucket position reaches the height of the interference avoidance position; and an angle estimation unit that is configured to specify an estimated swing angle by which swing is possible for the arrival time, wherein the timing determination unit determines the swing start timing based on the estimated swing angle and the remaining swing angle.

4. The control device according to claim 1, further comprising:

a swing time specification unit that is configured to specify a required swing time required for swinging the swing body by the remaining swing angle; and a height estimation unit that is configured to specify an estimated bucket height to which the height of the bucket position is able to rise for the required swing time, wherein the timing determination unit determines the swing start timing based on the estimated bucket height and the height of the interference avoidance position.

5. A control method of a loading machine including a swing body that swings around a center of swing and a work equipment that is attached to the swing body and has a bucket, the control method comprising the steps of:

specifying an interference avoidance position which is a bucket position that is higher than a loading object and has no loading object therebelow;

determining a swing start timing based on a remaining swing angle and a height of the interference avoidance position, the remaining swing angle being formed by a straight line that extends from the center of swing to the work equipment and a straight line that extends from the center of swing to the interference avoidance position in a plan view from above; and outputting an operation signal of the work equipment in a case of not reaching the swing start timing; and outputting an operation signal for swinging the swing body at swing speed higher than that when not reaching the swing start timing and an operation signal of the work equipment, in a case of reaching the swing start timing.

* * * * *